US007690436B2

(12) United States Patent
Turley et al.

(10) Patent No.: US 7,690,436 B2
(45) Date of Patent: Apr. 6, 2010

(54) PRESSURE ISOLATION PLUG FOR HORIZONTAL WELLBORE AND ASSOCIATED METHODS

(75) Inventors: Rocky Turley, Houston, TX (US); John McKeanchnie, Vernal, UT (US)

(73) Assignee: Weatherford/Lamb Inc., Houston, TX (US)

( * ) Notice: Subject to any disclaimer, the term of this patent is extended or adjusted under 35 U.S.C. 154(b) by 229 days.

(21) Appl. No.: 11/742,835

(22) Filed: May 1, 2007

(65) Prior Publication Data

US 2008/0271898 A1 Nov. 6, 2008

(51) Int. Cl.
*E21B 33/12* (2006.01)

(52) U.S. Cl. ..... 166/387; 166/241.3; 166/135

(58) Field of Classification Search ..... 166/387, 166/382, 130, 138, 386, 135, 241.3, 241.6
See application file for complete search history.

(56) References Cited

U.S. PATENT DOCUMENTS 1,436,274 A 11/1922 Mack
1,684,266 A 9/1928 Fisher et al.
1,690,721 A 11/1928 Dillon
1,809,080 A 6/1931 Sweet
1,949,498 A 3/1934 Stone et al.
2,160,804 A 5/1939 Hall et al.
2,569,457 A * 10/1951 Dale et al. ..... 166/123
3,403,731 A 10/1968 Armais
3,625,281 A * 12/1971 Herd et al. ..... 166/344
3,667,543 A 6/1972 Dean
3,905,227 A 9/1975 Kinley
4,151,875 A 5/1979 Sullaway
4,185,689 A 1/1980 Harris (Continued)

FOREIGN PATENT DOCUMENTS

EP 0 454 466 A2 10/1991

(Continued)

OTHER PUBLICATIONS

"Baker introduces two packers as corrosion-proof as fiberglass tubing—because they are fiberglass!", Baker Fiberglass Packers, Baker Oil Tools, Inc., World Oil, Jun., 1968, 3-pgs.

(Continued)

*Primary Examiner*—Jennifer H Gay
*Assistant Examiner*—Cathleen R Hutchins
(74) *Attorney, Agent, or Firm*—Wong, Cabello, Lutsch, Rutherford & Brucculeri, LLP

(57) ABSTRACT

A wellbore pressure isolation apparatus is deployed in a wellbore and has a sealing element that can be activated to seal against an interior surface of a surrounding tubular. Once set, a ball valve in the apparatus restricts upward fluid communication through the apparatus, and another ball valve in the apparatus can restrict downward fluid communication through the apparatus. These ball valve can have disintegratable balls intended to disintegrate in wellbore conditions after different periods of time. To facilitate deployment of the apparatus in a horizontal section of the well bore, the apparatus has a plurality of rollers positioned on a distal end. In addition, the apparatus has a ring disposed about the body between the distal body portion and an adjacent body portion. The ring has an outside diameter at least greater than that of the adjacent body portion to facilitate pumping of the apparatus in the wellbore.

42 Claims, 5 Drawing Sheets

U.S. PATENT DOCUMENTS

| | | | | |
|---|---|---|---|---|
| 4,424,861 | A | 1/1984 | Carter et al. | |
| 4,708,202 | A | 11/1987 | Sukup et al. | |
| 4,836,279 | A | 6/1989 | Freeman | |
| 4,941,511 | A | 7/1990 | Johansen et al. | |
| 5,224,540 | A | 7/1993 | Streich et al. | |
| 5,271,468 | A | 12/1993 | Streich et al. | |
| 5,293,905 | A * | 3/1994 | Friedrich | 138/89 |
| 5,390,737 | A | 2/1995 | Jacobi et al. | |
| 5,947,213 | A | 9/1999 | Angle et al. | |
| 6,050,789 | A | 4/2000 | Melby et al. | |
| 6,325,144 | B1 | 12/2001 | Turley et al. | |
| 6,325,151 | B1 | 12/2001 | Vincent et al. | |
| 6,431,275 | B1 | 8/2002 | Turley | |
| 6,464,008 | B1 | 10/2002 | Roddy et al. | |
| 6,478,086 | B1 | 11/2002 | Hansen | |
| 6,595,283 | B1 | 7/2003 | Turley et al. | |
| 6,712,153 | B2 | 3/2004 | Turley et al. | |
| 6,769,491 | B2 | 8/2004 | Zimmerman et al. | |
| 7,036,602 | B2 | 5/2006 | Turley et al. | |
| 7,124,831 | B2 | 10/2006 | Turley et al. | |
| 7,350,583 | B2 | 4/2008 | Nguyen et al. | |
| 7,389,823 | B2 | 6/2008 | Turley et al. | |
| 2002/0157827 | A1 | 10/2002 | Roddy et al. | |
| 2003/0000710 | A1 | 1/2003 | Turley et al. | |
| 2003/0188860 | A1 | 10/2003 | Zimmerman et al. | |
| 2003/0226668 | A1 | 12/2003 | Zimmerman et al. | |
| 2004/0177952 | A1 | 9/2004 | Turley et al. | |
| 2004/0216871 | A1 | 11/2004 | Mendez et al. | |
| 2005/0121201 | A1 | 6/2005 | Turley et al. | |
| 2005/0189104 | A1 | 9/2005 | Turley et al. | |
| 2006/0124307 | A1 | 6/2006 | Turley et al. | |
| 2006/0131031 | A1 | 6/2006 | McKeachnie et al. | |
| 2006/0278405 | A1 | 12/2006 | Turley et al. | |
| 2007/0039160 | A1 | 2/2007 | Turley et al. | |
| 2007/0074873 | A1 | 4/2007 | McKeachnie et al. | |
| 2008/0128133 | A1 | 6/2008 | Turley et al. | |

FOREIGN PATENT DOCUMENTS

| | | | |
|---|---|---|---|
| GB | 2427220 | A | 12/2006 |
| SU | 1263809 | A1 | 10/1986 |
| SU | 1543046 | A1 | 2/1990 |
| WO | WO 9966171 | A2 | 12/1999 |
| WO | WO 03/067016 | A3 | 8/2003 |

OTHER PUBLICATIONS

UK Search Report for application No. GB0804325.9, dated May 30, 2008.

First Office Action in U.S. Appl. No. 11/152,409, mailed Mar. 30, 2007.

Response to First Office Action in U.S. Appl. No. 11/152,409, mailed Jul. 2, 2007.

Second Office Action in U.S. Appl. No. 11/152,409, mailed Sep. 20, 2007.

Response to Second Office Action in U.S. Appl. No. 11/152,409, mailed Dec. 20, 2007.

Final Office Action in U.S. Appl. No. 11/152,409, mailed Apr. 3, 2008.

Response to Final Office Action in U.S. Appl. No. 11/152,409, mailed Jun. 3, 2008.

Notice of Allowance and Fees Due in U.S. Appl. No. 11/152,409, mailed Jun. 12, 2008.

Office Action from Canadian Intellectual Property Office for counterpart application No. 2,624,368, dated Oct. 10, 2009, 2-pgs.

* cited by examiner

PRESSURE ISOLATION PLUG FOR HORIZONTAL WELLBORE AND ASSOCIATED METHODS

FIELD OF THE DISCLOSURE

The subject matter of the present disclosure generally relates to pressure isolation plugs for oil and gas wells and more particularly to pressure isolation plugs that can be advantageously deployed in wellbores having horizontal sections.

BACKGROUND OF THE DISCLOSURE

FIG. 1A shows a cross-sectional view of a wellbore 10 having a casing 20 positioned through a formation. Typically, the casing 20 is set with concrete to strengthen the walls of the wellbore 10. Once the casing 20 is set, various completion operations are performed so that oil and gas can be produced from the surrounding formation and retrieved at the surface of the well. In the completion operations, completion equipment, such as perforating guns, setting tool, and pressure isolation plugs, are deployed in the wellbore 10 using a wireline or slick line.

The wellbore 10 is shown in a stage of completion after perforating guns have formed perforations 13, 15 near production zones 12, 14 of the formation. At the stage shown, a pressure isolation plug 100 on the end of a wireline 40 has been deployed downhole to a desired depth for isolating pressures in the wellbore 10. The plug 100, which is shown in partial cross-section in FIG. 1B, has a mandrel 110 and a packing element 120 disposed between retainers 150A-B and slips 130A-B. The overall outside diameter D of the plug 100 can be about 3.665-inches for deployment within casing 20 having an inside diameter of about 3.920 or 4.090-inches.

After being deployed in the casing 20, a setting tool sets the tool by applying axial forces to the upper slip 130A while maintaining the mandrel 110 and the lower slip 130B in a fixed position. The force drives the slips 130A-B up cones 140A-B so that the slips 130A-B engage the inner walls of the casing 20. In addition, the force compresses the packing element 120 and forces it to seal against the inner wall of the casing 20. In this manner, the compressed packing element 120 seals fluid communication in the annular gap between the plug 100 and the interior wall of the casing 20, thereby facilitating pressure isolation.

Once set in the desired position within the wellbore 10, the plug 100 can function as a bridge plug and a frac plug. For example, the plug 100 has a lower ball 180 and a lower ball seat 118 that allow the plug 100 to function as a bridge plug. In the absence of upward flow, the lower ball 180 is retained within the plug 100 by retainer pin 119. When there is upward flow, however, the lower ball 180 engages the lower ball seat 118, thereby restricting flow through the plug 100 and isolating pressure from below. During completion or production operations, for example, the plug 100 acting as a bridge plug can sustain pressure from below the plug 100 and prevent the upward flow of production fluid in the wellbore 10.

To function as a frac plug, for example, the plug 100 has an upper ball 160 and an upper ball seat 116 in the plug. In the absence of downward flow, the upper ball 160 is retained within the plug by retainer pin 117. When there is downward flow of fluid, however, the upper ball 160 engages the upper ball seat 116, thereby restricting flow of fluid through the plug and isolating pressure from above. In a fracing operation, for example, operators can pump frac fluid from the surface into the wellbore 10. Acting as a frac plug, the plug 100 can sustain the hyrdualic pressure above the plug 100 so that the frac fluid will interact with the upper zone 12 adjacent to upper perforations 13 and will not pass below the plug 100.

Although FIG. 1A shows the pressure isolation plug 100 used in a vertical section of wellbore 10, wellbores may also have horizontal sections. Unfortunately, moving completion equipment, such as perforating guns, setting tool, and plugs, in a horizontal section of a wellbore can prove difficult for operators. For example, if a plug is to be used to isolate a bottom zone of a wellbore having a horizontal section, then perforating guns and other equipment must be moved downhole through the horizontal section using a tractor or coil tubing. As one skilled in the art will appreciate, the use of tractors or coil tubing in horizontal applications can be very time consuming and expensive.

Accordingly, a need exists for a pressure isolation plug that can be advantageously used in wellbores having not only vertical sections but also horizontal sections and that can allow perforating guns and other equipment to be moved downhole without the need of tractors or coil tubing. The subject matter of the present disclosure is directed to overcoming, or at least reducing the effects of, one or more of the problems set forth above.

SUMMARY OF THE DISCLOSURE

A wellbore pressure isolation plug is deployed in a wellbore and has a sealing element that can be activated to seal against an interior surface of a surrounding tubular. Once set, a ball valve in the plug restricts upward fluid communication through the plug, and another ball valve in the plug can restrict downward fluid communication through the plug. To facilitate deployment of the plug in a horizontal section of the wellbore, the plug has a plurality of rollers positioned on a distal body portion. In addition, the plug has a ring disposed about its body between the distal body portion and an adjacent body portion. This ring has an outside diameter at least greater than that of the adjacent body portion. The increase diameter ring enhances a pressure differential across the plug that facilitates pumping of the plug in the wellbore, and especially within a horizontal section of the wellbore.

DETAILED DESCRIPTION

Figure 1A:
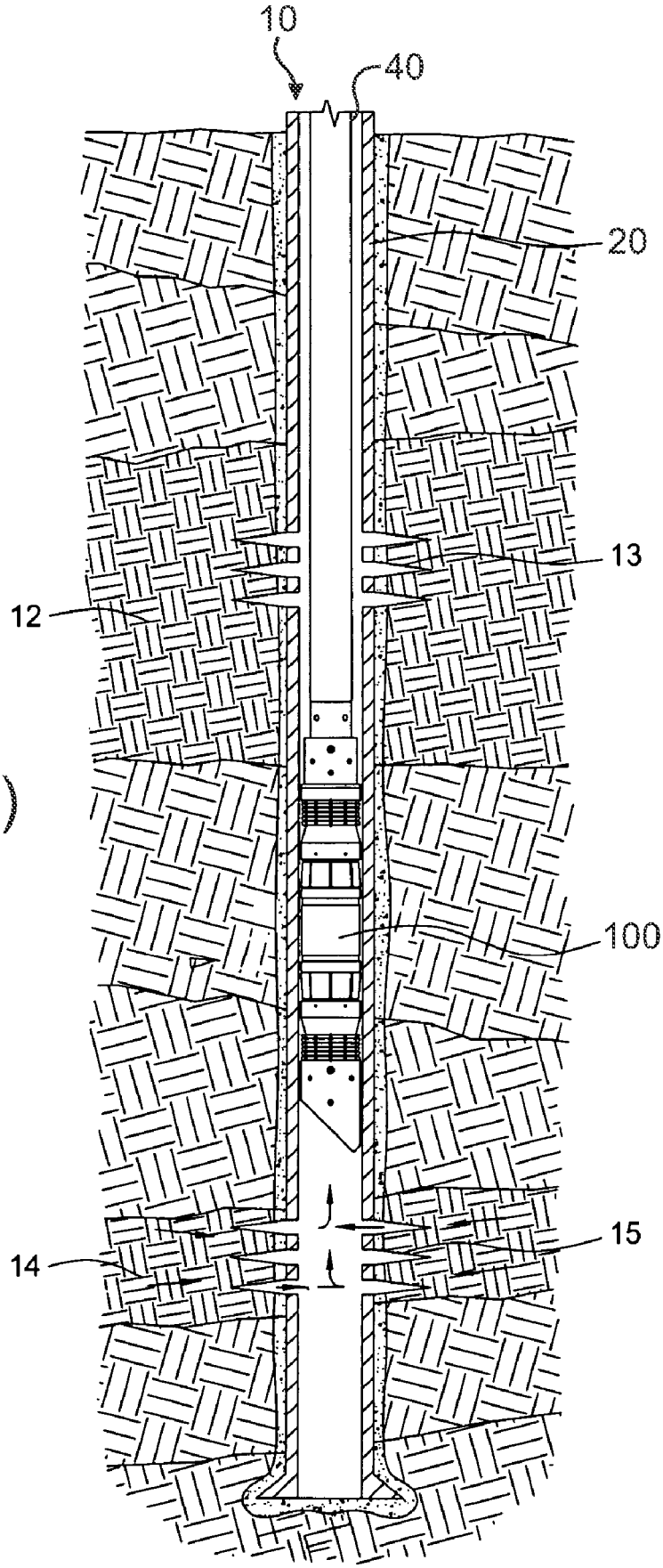
FIG. 1A (Prior Art)
FIG. 1A illustrates a plug according to the prior art positioned in a wellbore.
Figure 1B:
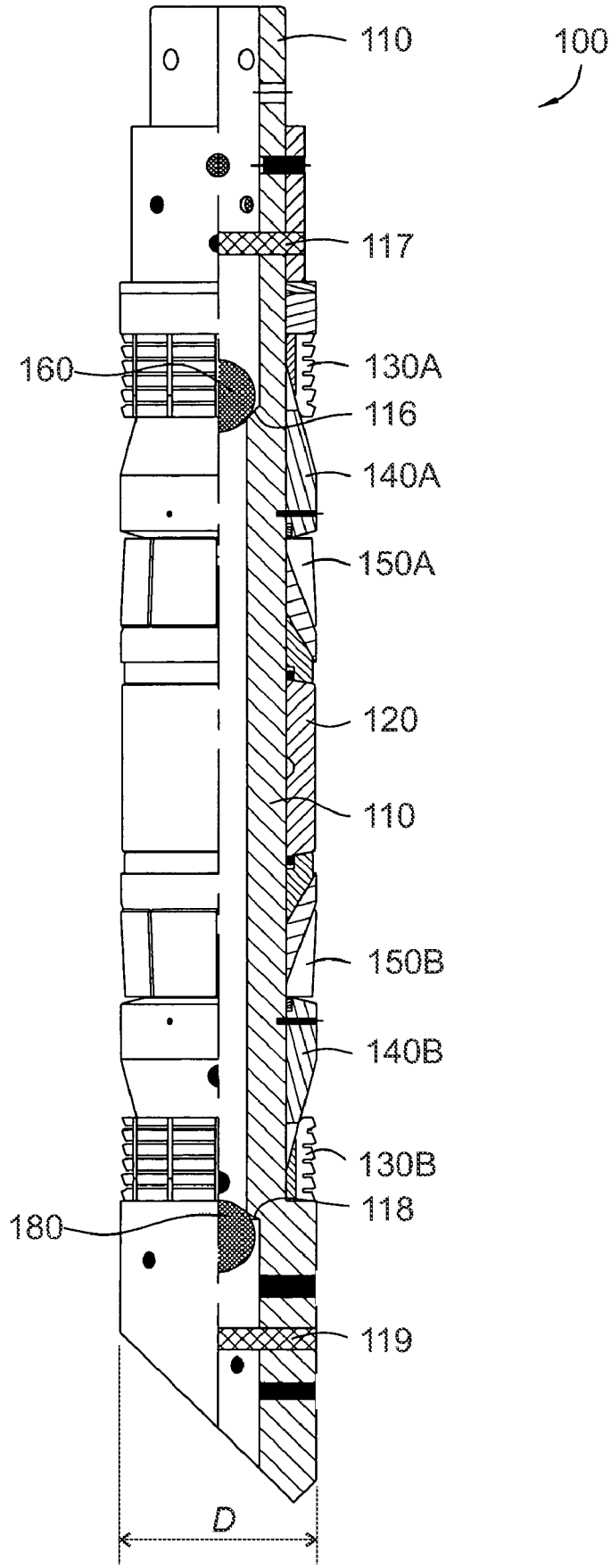
FIG. 1B (Prior Art)
FIG. 1B illustrates the prior art plug of FIG. 1A in more detail.
Figure 2A:
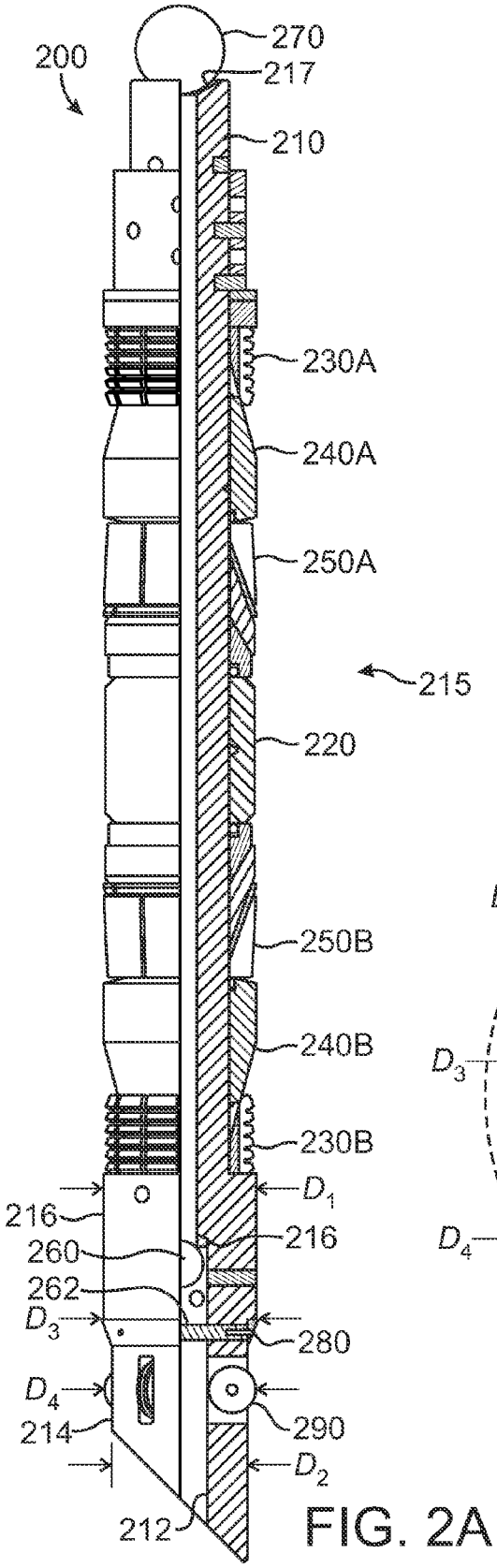
FIG. 2A illustrates a plug according to one embodiment of the present disclosure in partial cross-section.

Referring to FIG. 2A, a plug 200 according to one embodiment of the present disclosure is illustrated in partial cross-section. The plug 200 includes a mandrel 210 and a sealing system 215 disposed about the mandrel 210. The sealing system 215 includes a packing element 220, slips 230A-B, cones 240A-B, and retainers 250A-B, similar to the components disclosed in U.S. Pat. No. 6,712,153, which is incorporated herein by reference in its entirety. The plug 200 and sealing system 215 can also be composed of non-metallic components made of composites, plastics, and elastomers according to the techniques disclosed in incorporated U.S. Pat. No. 6,712,153.

Figure 4A:
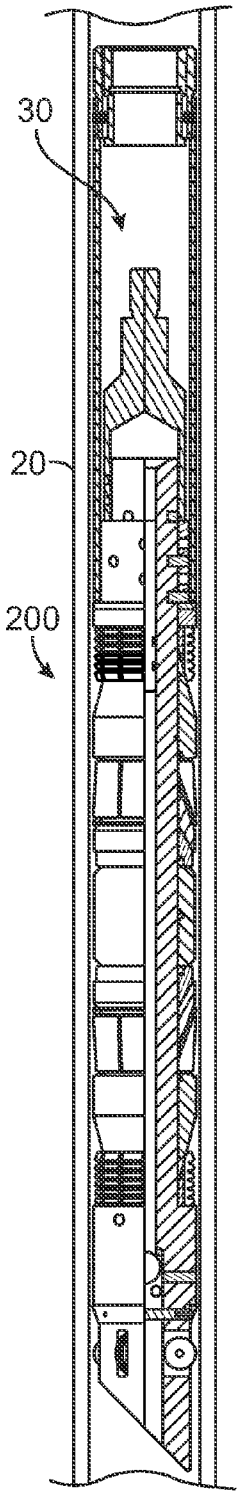
FIG. 4A illustrates the plug of FIG. 2A in casing having wireline setting equipment.
Figure 4B:
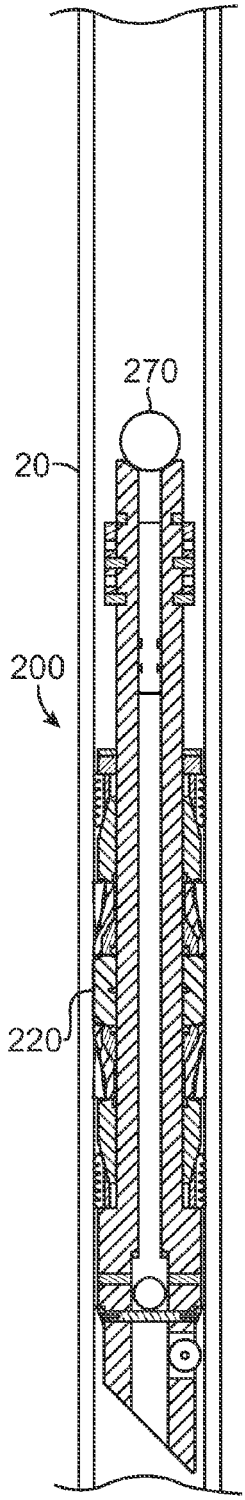
FIG. 4B illustrates the plug of FIG. 2A in cross-section in a pressure isolation configuration within casing.

When used in a wellbore, the plug 200 is essentially actuated in the same way discussed previously to form a pressure isolation seal between the packing element 220 and the inner wall of surrounding casing or the like. For example, the plug 200 can be deployed in the wellbore using any suitable conveyance means, such as wireline, threaded tubing, or continuous coil tubing. In addition, an appropriate setting tool known in the art can be used to set the plug 200 once deployed to a desired position. In FIG. 4A, for example, the plug 200 has a wireline setting kit 30 attached to the end of the plug 200. In this configuration, the plug 200 can be run into position within a wellbore on a wireline (not shown), and a wireline pressure setting tool (not shown) can apply the forces necessary to drive the slips 250A-B over the cones 240A-B and to compress the packing element 220 against the casing 20, as shown in FIG. 4B.

Figure 5:
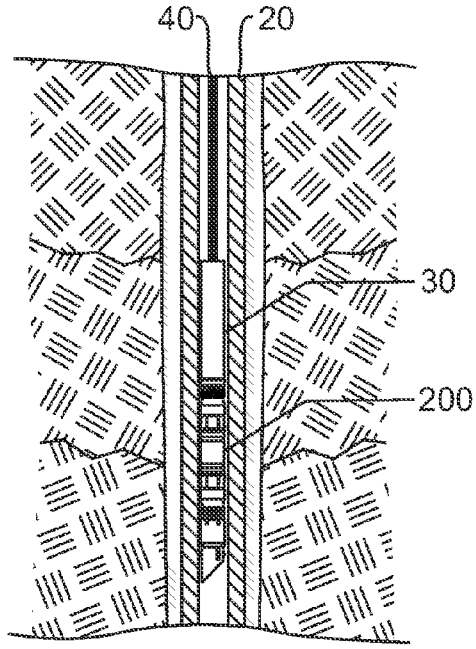
FIG. 5 illustrates the plug of FIG. 2A being run into a vertical section of a wellbore.
Figure 6:
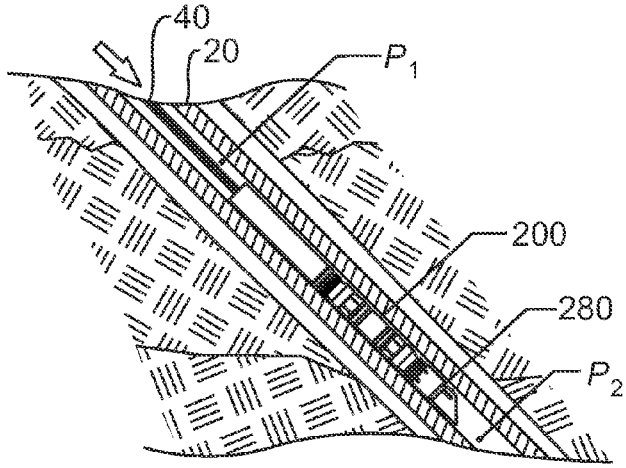
FIG. 6 illustrates the plug of FIG. 2A being run into a substantially horizontal section of a wellbore.

When used in the wellbore, it may be the case that the plug 200 is run through a vertical section as illustrated in FIG. 5 or a horizontal section as illustrated in FIG. 6. As noted in the Background of the present disclosure, deploying a plug and other equipment in a horizontal section of a wellbore strictly using a wireline 40 may prove ineffective because slack may develop in the wireline 40, making it difficult to convey the plug and equipment further. Typically, a tractor or coil tubing must be used, which can be very time consuming and expensive. However, the plug 200 can overcome these limitations by enabling operators to pump the plug 200 in the wellbore and especially in a horizontal section of the wellbore.

Figure 2B:
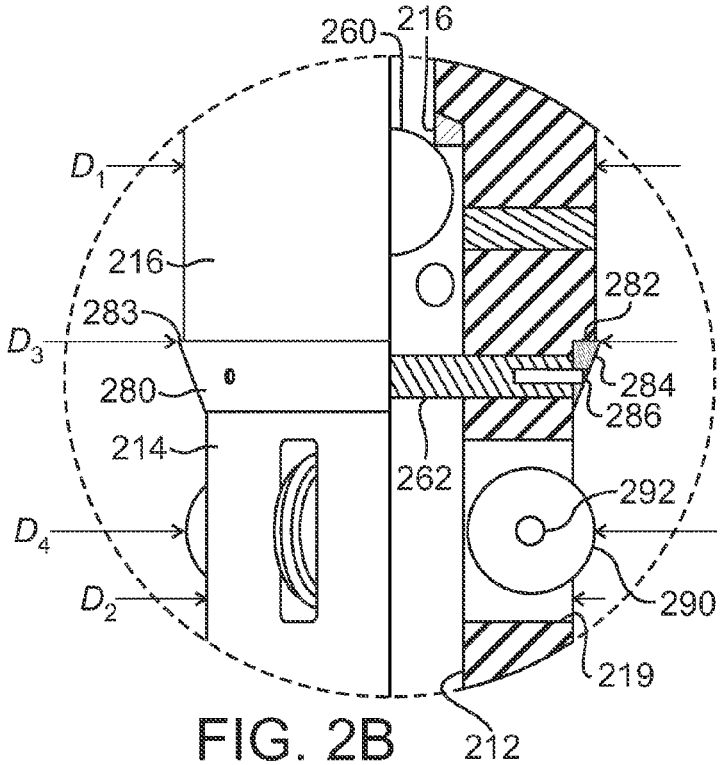
FIG. 2B illustrate a detail of the plug of FIG. 2A.

To facilitate deployment of the plug 200 in a horizontal section, the plug 200 has a distal portion 214 as shown in FIG. 2A-2B. This distal portion 214 has a smaller diameter $D_2$ that is less than an overall outer diameter $D_1$ of the rest of the plug 200. In addition, the distal portion 214 has rollers 290 that are held in roller ports 219 by pins 292 and that help facilitate downhole movement of the plug 200 through a horizontal section. The rollers 290 are preferably composed of Ultra-High Molecular Weight (UHMW) thermoplastic material, and the pins 292 are preferably composed of thermoset epoxy with fiberglass reinforcement.

Figure 3A:
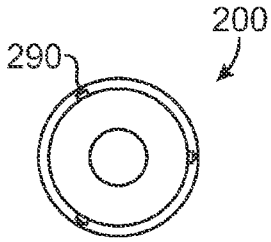
FIGS. 3A-3B illustrate end views of two sizes of the disclosed plug.
Figure 3B:
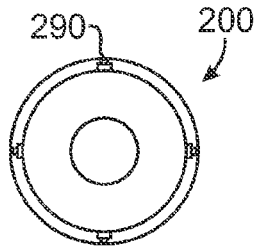

The number of rollers 290 used on the plug 200 depends in part on the overall outside diameter $D_1$. For example, FIG. 3A shows a first end view of the plug 200 having three rollers 290 positioned about every 120-degrees around the distal portion's circumference, which may be suitable when the plug 200 has an overall outside diameter $D_1$ of about 4.5-inches. By contrast, FIG. 3B shows a second end view of the plug 200 having four rollers 290 positioned about every 90-degrees around the distal portion's circumference, which may be suitable when the plug 200 has an overall outside diameter $D_1$ of about 5.5-inches. FIGS. 3A-3B provide two examples of possible arrangements for the rollers 290 that can be used on the disclosed plug 200. Various other arrangements are also possible.

To further facilitate deployment of the plug 200 in a horizontal section, the plug 200 has a ring 280 positioned between the smaller diameter $D_2$ of the distal portion 214 and the larger diameter $D_1$ of the adjacent portion 216 of the mandrel 210. In one embodiment, the ring 280 can be integrally formed with the mandrel 210 and composed of the same material. In the present embodiment, the ring 280 is a separate component preferably composed of Teflon.

As shown in more detail in FIG. 2B, the ring 280 is held by pins 284 at the shoulder defined between the distal portion 214 and the adjacent portion 216 of the mandrel 210, although the ring 280 could be held by a welds, epoxy, glue, an interference fit, or other means known in the art. Portion 283 of an orthogonal surface 282 extends beyond the outer diameter $D_1$ of the adjacent body portion 216 and creates a shoulder that increases the overall outside diameter of the plug 200. This increased diameter increases the ability to develop a suitable pressure differential across the plug 200 when positioned in casing and enables the plug 200 to be pumped in a wellbore and especially in a horizontal section. As shown in FIG. 6, for example, pumped fluid from the surface produces a rear pressure $P_1$ behind the plug 200 when in a horizontal section of a wellbore. Facilitated by the increased diameter of the ring 280 and other features of the plug 200 disclosed herein, this rear pressure $P_1$ is greater than the forward pressure $P_2$ in the wellbore before the plug 200. With this pressure differential, the plug 200 can be advantageously pumped through the horizontal section.

Selection of the various outside cross-sectional diameters to use for the plug's components depends on a number of factors, such as the inside diameter of the casing, the drift diameter of the casing, the pressure levels, etc. As shown in FIGS. 2A-2B, the rollers 290 extend out to an outside diameter $D_4$ that is preferably less than the overall outside diameter $D_1$ of the plug 200. Selection of an appropriate outside diameter $D_1$ for the plug's mandrel 210 is preferably based on a desired run-in clearance between the mandrel 210 and the casing or other requirement for a given implementation. Likewise, selection of an appropriate outside diameter $D_2$ for the distal portion 214 depends on the outside diameter $D_1$, the size of the rollers 290, and other possible variables and is preferably based on clearances known in the art that will allow the plug 200 to be run through horizontal sections of casing 20 without getting stuck. The outside diameter $D_4$ of the rollers 290 can be approximately the same as the drift diameter of the casing in which the plug 200 is intended to be used. As is known, for example, the American Petroleum Institute's (API) standard for drift diameters in casing and liners of less that 9⅝-inches in diameter is calculated by subtracting ⅛-inch from the nominal inside diameter of the casing or liner.

Furthermore, the outside diameter $D_3$ of the ring 280 (and hence the size of the exposed portion 283) to use for a given implementation of the plug 200 can depend on a number of implementation-specific details, such as the diameter of the wellbore casing 20, overall diameter $D_1$ of the plug's mandrel 210, fluid pressures, grade of the horizontal section of the wellbore, etc. As shown, the diameter $D_3$ of the ring 280 can be at least greater than the lager outside diameter $D_1$ of the mandrel 210 and at least less than the inside diameter of the surrounding casing 20. In one example, the ring's diameter $D_3$ can be anywhere between 80-100% of the drift diameter of the casing in which it is intended to be used and is preferably about 95% of the intended casing's drift diameter.

In one illustrative example, the plug 200 may have an outside diameter $D_1$ of about 3.665-inches and may be intended for use in casing 20 having an inside diameter of about 3.920-inches. The distal portion 214 may have a diameter $D_2$ of about 3.25-inches. The ring 280 for such a configuration may have an outside diameter $D_3$ of about 3.724-inches, and the rollers 290 may have an outside diameter $D_4$ of about 3.795-inches. In another illustrative example, the same plug 200 having outside diameter $D_1$ of about 3.665-inches may likewise be intended for use in casing 20 having a larger inside diameter of about 4.090-inches. In this example, the ring 280 for such a configuration may have an outside diameter $D_3$ of about 3.766-inches and the rollers 290 may have an outside diameter $D_4$ of about 3.965-inches.

Once deployed and set in a wellbore, the plug 200 is capable of functioning as a bridge plug and/or a frac plug. For example, a lower ball 260 and a lower ball seat 216 allow the plug 200 to function as a bridge plug. When upward flow of fluid (e.g., production fluid) causes the lower ball 260 to engage the lower ball seat 216, the plug 200 restricts upward flow of fluid through the plug's bore 212 and isolates pressure from below the plug 200. In the absence of any upward flow, the lower ball 260 is retained within the plug 200 by retainer pin 262.

An upper ball 270 and an upper ball seat 217 also allow the plug 200 to function as a frac plug. This upper ball 270 can be dropped to the plug 200 so it can seat on the upper ball seat 217 at the end of the mandrel 210. The upper ball 270 can be urged upwards and away from the ball seat 217 by upward flow of the production fluid. In fact, the ball 270 can be carried far enough upward so that it no longer affects the upward flow of the production fluid. When there is downward fluid flow during a frac operation, the ball 270 engages the ball seat 217 and isolates the wellbore below the plug 200 from the fracing fluid above the plug 200.

During use, the plug 200 is attached to an adapter kit that is attached to a setting tool with perforating guns above, and the entire assembly is deployed into the wellbore via a wireline 40 or other suitable conveyance member. If needed during deployment and as shown in FIG. 6, the plug 200 can be advantageously pumped through a horizontal section of the wellbore while still coupled to the wireline 40 and without the need for using a tractor or coil tubing. Once positioned at the desired location, the plug 200 can be set using the setting tool as described above so that the annulus between the plug 200 and the surrounding casing 20 is plugged.

After being set, the upward flow of production fluid can be stopped as the lower ball 260 seats in the ball seat 216. The perforating guns can then be raised to a desired depth, and the guns can be fired to perforate the casing 20. If the guns do not fire, the wireline 40 with the unfired guns can be pulled from the wellbore, and new guns can be installed on the wireline 40. The new guns can then be pump to the desired depth because the ball 260 and seat 216 in the plug 200 allow fluid to be pumped through it.

Once the casing is perforated, the plug 200 allows fracing equipment to be pumped downhole while the plug 200 is set. To then commence frac operations, operators can drop the upper ball 270 from the surface to seal on the upper seat 217 of the plug 200, allowing the operators to commence with the frac operations. Downward flow of fracing fluid ensures that the upper ball 270 seats on the upper ball seat 217, thereby allowing the frac fluid to be directed into the formation through corresponding perforations.

After a predetermined amount of time and after the frac operations are complete, the production fluid can be allowed to again resume flowing upward through the plug 200, towards the surface. For example, the lower ball 260 can be configured to disintegrate into the surrounding wellbore fluid after a period of time, or the plug 200 can be milled out of the casing 20 using techniques known in the art. The above operations can be repeated for each zone that is to be fractured with a frac operation. Of course, the plug 200 of FIG. 2A could be used only as a bridge plug if the second ball 270 is not used to seal off pressure from above.

Other embodiments of plugs may have different configurations of check or ball valves than plug 200 in FIGS. 2A-2B. In general, the disclosed plug can function as a bridge plug and/or a frac plug and can use at least one check or ball valve to restrict fluid communication through the plug's internal bore in at least one direction. For example, FIGS. 7A-7D illustrate alternative embodiments of plugs in accordance with certain teachings of the present disclosure. Each of these embodiments includes the ring 280 and rollers 290 discussed previously as well as the mandrel 210 and sealing element 215 (e.g., packing element, slips, cones, and retainers). However, each of these embodiments has different arrangements of ball valves or other components as detailed below.

Figures 7A, 7B, 7C, 7D:
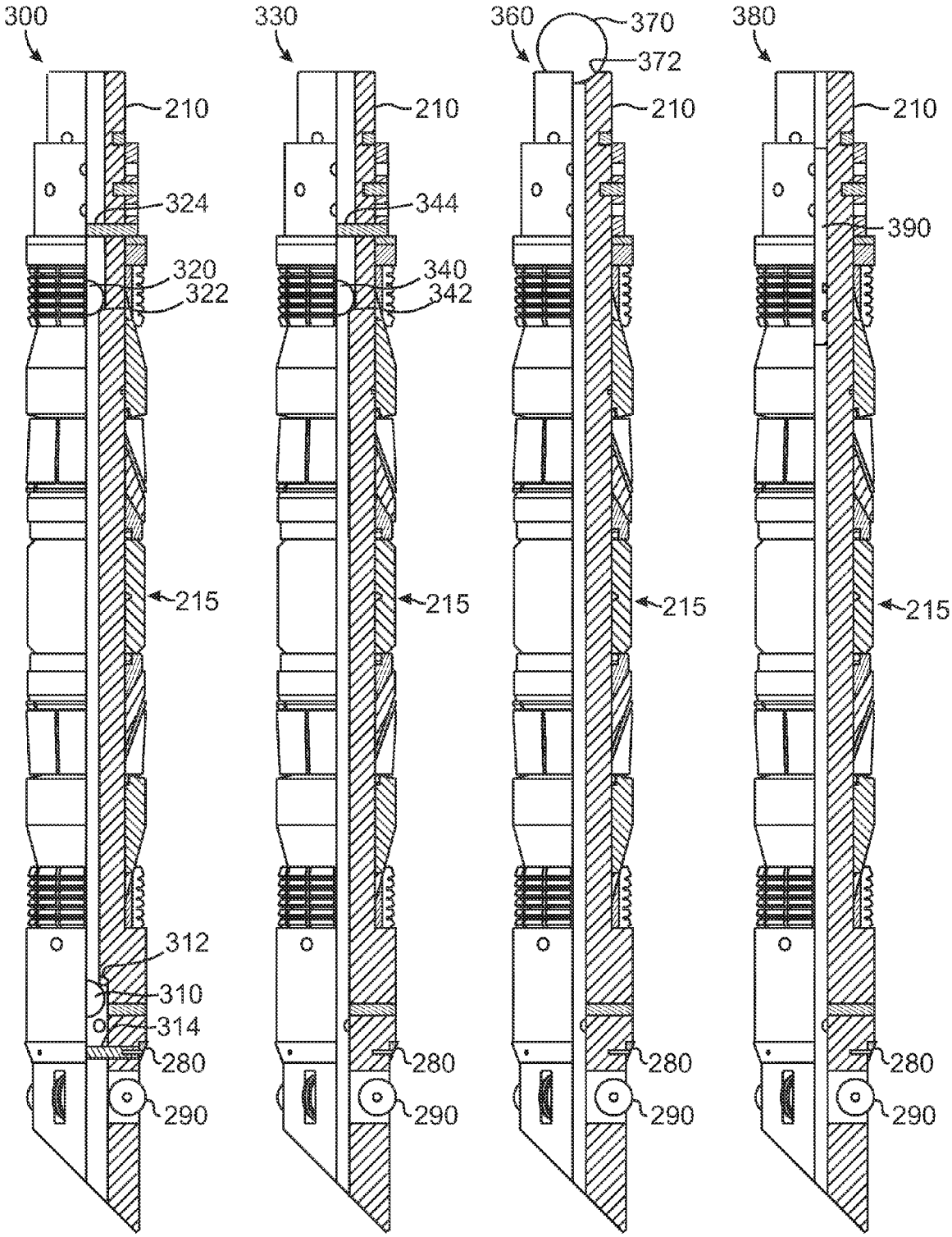
FIGS. 7A-7D illustrate alternative embodiments of a plug in accordance with certain teachings of the present disclosure.

In FIG. 7A, the plug 300 has a lower ball 310 seating on lower seat 312 and retained by pin 314 and has an upper ball 320 seating on upper seat 322 and retained by upper pin 324. This plug 300 can act as both a frac plug and a bridge plug by isolating pressure from both above and below in a similar way as the embodiment of FIG. 2A. FIGS. 7B-7C shows embodiments of plugs for sustaining pressure from a single direction, which in this case is from above, so that the plugs function as frac plugs. In FIG. 7B, for example, the plug 330 has an upper ball 340 seating on upper seat 342 and retained by upper pin 344. In FIG. 7C, for example, the plug 360 has an upper seat 372 onto which an upper ball 370 can be dropped and seated to commence fracing operations. In FIG. 7D, the plug 380 has an insert 390 positioned in the inner bore of the mandrel 210 so the plug 380 can act strictly as a bridge plug. The insert 390 may be held in place by an interference fit and/or by a pin (not visible) that passes through the insert 390 and through holes in the mandrel 210. In another alternative, the plug 380 may not even have an inner bore therethrough so the plug 380 could act as a bridge plug without the need of such an insert 390.

In general, the balls used in the ball valves of the disclosed plugs can be composed of any of a variety of materials. In one embodiment, one or more of the balls can be constructed of material designed to disintegrate after a period of time when exposed to certain wellbore conditions as disclosed in U.S. Pat. Pub. No. 2006/0131031, which is incorporated herein by reference in its entirety. For example, the disintegratable material can be a water soluble, synthetic polymer composition including a polyvinyl, alcohol plasticizer, and mineral filler. Furthermore, other portions of the disclosed plugs, such as portion of the sealing system 215, can also be made of a disintegratable material and constructed to lose structural integrity after a predetermined amount of time.

The foregoing description of preferred and other embodiments is not intended to limit or restrict the scope or applicability of the inventive concepts conceived of by the Applicants. For example, the ring 280 may be disposed in any of a variety of locations along the length of the disclosed plug and not necessarily only in the location shown in the Figures. Moreover, the rollers 290 also may be positioned in any of a variety of locations along the length of the disclosed plug as well. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellbore pressure isolation apparatus, comprising:

a body having a distal body portion and an adjacent body portion, the distal body portion having a first outside diameter, the adjacent body portion having a second outside diameter that is greater than the first outside diameter;

a sealing element disposed about the body and activatable to seal against an interior surface of a surrounding tubular of a wellbore;

a plurality of rollers positioned on the distal body portion; and a ring disposed about the body between the distal body portion and the adjacent body portion, the ring having a third outside diameter that is at least greater than the second outside diameter of the adjacent body portion, wherein the rollers are positioned around the first outside diameter of the distal body portion and extend to a fourth outside diameter around the distal body portion, the fourth outside diameter being greater than the first outside diameter of the distal body portion and being less than the second outside diameter of the adjacent body portion.

2. The apparatus of claim 1, wherein the plurality of rollers are substantially equally positioned around a circumference of the distal body portion.

3. The apparatus of claim 1, wherein each of the rollers is rotatable on a pin, the pin positioned in an opening defined in an outside surface of the distal body portion.

4. The apparatus of claim 3, wherein the opening communicates with a bore of the body.

5. The apparatus of claim 1, wherein the ring is integrally formed on an outside surface of the body.

6. The apparatus of claim 1, wherein the ring comprises a separate ring component positioned on an outside surface of the body between the distal body portion and the adjacent body portion.

7. The apparatus of claim 6, wherein the separate ring component is positioned at a shoulder, the shoulder defined by the first outside diameter of the distal body portion being smaller than the second outside diameter of the adjacent body portion.

8. The apparatus of claim 7, wherein a plurality of pins retains the separate ring component at the shoulder.

9. The apparatus of claim 6, wherein the separate ring component comprises an orthogonal side and a slanted side, the orthogonal side having the third outside diameter, the slanted side angled from the distal body portion to the orthogonal side.

10. The apparatus of claim 1, wherein the body defines a bore therethrough, and wherein the apparatus further comprises an insert positioned in the bore to restrict fluid communication through the bore.

11. The apparatus of claim 1, wherein the body defines a bore therethrough, and wherein the apparatus further comprises at least one valve to restrict fluid communication through the bore in at least one direction.

12. The apparatus of claim 11, wherein the at least one valve comprises a first valve having a first ball and a first seat, the first ball positioned in the bore and engageable with the first seat in the bore when moved in the at least one direction.

13. The apparatus of claim 12, further comprising a retainer positioned in the bore to prevent movement of the ball past the retainer in an opposing direction to the at least one direction.

14. The apparatus of claim 12, wherein the at least one valve comprises a second valve having a second ball and a second seat, the second ball positioned in the bore and engageable with the second seat in the bore when moved in an opposing direction to the at least one direction.

15. The apparatus of claim 12, wherein the at least one valve comprises a second valve having a second seat on a proximate body portion of the body, the second seat capable of engaging a second ball positioned in the wellbore to restrict fluid communication in an opposing direction to the at least one direction.

16. The apparatus of claim 1, wherein the plurality of rollers positioned on the distal body portion facilitate travel of the apparatus in a substantially horizontal section of the wellbore.

17. The apparatus of claim 16, wherein the ring disposed about the body between the distal and adjacent body portions facilitates pumping of the apparatus in the substantially horizontal section of the wellbore.

18. The apparatus of claim 1, wherein the ring disposed about the body between the distal and adjacent body portions facilitates pumping of the apparatus in a substantially horizontal section of the wellbore.

19. The apparatus of claim 18, wherein the plurality of rollers positioned on the distal body portion facilitate travel of the apparatus in the substantially horizontal section of the wellbore.

20. A wellbore pressure isolation method, comprising:

deploying an apparatus in a tubular of a wellbore by installing a distal end of the apparatus in the tubular before a proximate end of the apparatus;

facilitating deployment of the apparatus in a horizontal section of the wellbore by allowing rollers on the distal end of the apparatus to engage the tubular, and producing a pressure differential across the apparatus to allow the apparatus to be at least partially pumped through the horizontal section of the wellbore;

activating a sealing element on the apparatus to substantially seal an annulus between the apparatus and the tubular;

initially allowing fluid communication through a first valve in a bore in the apparatus in only a first direction from the proximate end to the distal end during deployment; and subsequently isolating pressure after deployment by restricting fluid communication through the first valve in the bore in a second direction from the distal end to the proximate end.

21. The method of claim 20, wherein the act of allowing fluid communication through the apparatus in only a first direction comprises restricting upward fluid communication through the first valve in the apparatus to isolate pressure below the apparatus.

22. The method of claim 21, further comprising restricting downward fluid communication through a second valve in the apparatus to isolate pressure above the apparatus.

23. The method of claim 22, wherein restricting fluid communication through the second valve comprises seating a ball held internally in the bore of the apparatus against a seat defined in the bore.

24. The method of claim 22, wherein restricting fluid communication through the second valve comprises dropping a ball downhole and engaging the ball on a seat on the proximate end of the apparatus.

25. The method of claim 20, wherein restricting fluid communication through the first valve comprises seating a ball held internally in the bore of the apparatus against a seat defined in the bore.

26. The method of claim 20, wherein the apparatus comprises:

a body having a distal body portion at the distal end of the apparatus and having an adjacent body portion, the body defining the bore therethrough, the sealing element disposed about the body and activatable to seal against an interior surface of the surrounding tubular of the wellbore, the plurality of rollers positioned on the distal body portion; and a ring disposed about the body between the distal body portion and the adjacent body portion, the ring having a first outside diameter that is at least greater than a second outside diameter of the adjacent body portion, wherein the first valve restricting fluid communication through the bore in the second direction has a first ball and a first seat, the first ball positioned in the bore and engageable with the first seat in the bore when moved in the second direction.

27. The method of claim 26, wherein the distal body portion has a third outside diameter that is smaller than the second outside diameter of the adjacent body portion.

28. The method of claim 26, wherein the plurality of rollers are substantially equally positioned around a circumference of the distal body portion.

29. The method of claim 26, wherein the rollers extend to a third outside diameter around the distal body portion that is greater than a fourth outside diameter of the distal body portion and is less than the second outside diameter of the adjacent body portion.

30. The method of claim 26, wherein each of the rollers is rotatable on a pin, the pin positioned in an opening defined in an outside surface of the distal body portion.

31. The method of claim 30, wherein the opening communicates with the bore of the body.

32. The method of claim 26, wherein the ring is integrally formed on an outside surface of the body.

33. The method of claim 26, wherein the ring comprises a separate ring component positioned on an outside surface of the body between the distal body portion and the adjacent body portion.

34. The method of claim 33, wherein the separate ring component is positioned at a shoulder, the shoulder defined by the first outside diameter of the distal body portion that is smaller than the second outside diameter of the adjacent body portion.

35. The method of claim 34, wherein a plurality of pins retains the separate ring component at the shoulder.

36. The method of claim 33, wherein the separate ring component comprises an orthogonal side and a slanted side, the orthogonal side having the first outside diameter, the slanted side angled from the distal body portion to the orthogonal side.

37. The method of claim 26, wherein the apparatus further comprises an insert positionable in the bore to restrict fluid communication through the bore.

38. The method of claim 26, further comprising a retainer positioned in the bore to prevent movement of the first ball past the retainer in an opposing direction to the first direction.

39. The method of claim 26, further comprising a second valve having a second ball and a second seat, the second ball positioned in the bore and engageable with the second seat in the bore when moved in the first direction.

40. The method of claim 26, further comprising a second valve having a second seat on a proximate body portion of the body at the proximate end of the apparatus, the second seat engageable by a second ball positioned in the wellbore to restrict fluid communication in the first direction.

41. The method of claim 26, wherein the body is deployable down hole with the distal body portion preceding the adjacent body portion, and wherein the second direction extends from the distal body portion to the adjacent body portion.

42. The method of claim 26, wherein the plurality of rollers facilitate travel of the apparatus in a substantially horizontal section of the wellbore, and wherein the ring facilitates pumping of the apparatus in the substantially horizontal section of the wellbore.

* * * * *